US007962991B2

(12) United States Patent
Hohlbein

(10) Patent No.: US 7,962,991 B2
(45) **Date of Patent: *Jun. 21, 2011**

(54) TOOTHBRUSH

(75) Inventor: Douglas J. Hohlbein, Pennington, NJ (US)

(73) Assignee: Colgate-Palmolive Company, New York, NY (US)

( * ) Notice: Subject to any disclaimer, the term of this patent is extended or adjusted under 35 U.S.C. 154(b) by 1055 days.

This patent is subject to a terminal disclaimer.

(21) Appl. No.: 11/464,421

(22) Filed: Aug. 14, 2006

(65) Prior Publication Data

US 2006/0288507 A1 Dec. 28, 2006

Related U.S. Application Data

(63) Continuation of application No. 10/870,462, filed on Jun. 18, 2004, now Pat. No. 7,089,621, which is a continuation-in-part of application No. 10/601,106, filed on Jun. 20, 2003, now abandoned, application No. 11/464,421, and a continuation-in-part of application No. PCT/US03/30633, filed on Sep. 26, 2003, and a continuation-in-part of application No. PCT/US03/29497, filed on Sep. 17, 2003, and a continuation-in-part of application No. 29/189,729, filed on Sep. 10, 2003, now Pat. No. Des. 517,812.

(60) Provisional application No. 60/414,117, filed on Sep. 27, 2002, provisional application No. 60/418,776, filed on Oct. 16, 2002, provisional application No. 60/419,425, filed on Oct. 18, 2002, provisional application No. 60/412,290, filed on Sep. 20, 2002.

(51) Int. Cl.
*A46B 9/04* (2006.01)

(52) U.S. Cl. ..... 15/110; 15/167.1; 15/22.1

(58) Field of Classification Search ..... 15/22.2, 15/22.1, 167.1, 110, 170; 601/141, 142, 601/139; 433/127, 186
See application file for complete search history.

(56) References Cited

U.S. PATENT DOCUMENTS

| | | | |
|---|---|---|---|
| 411,910 | A | 10/1889 | Van Horne |
| 585,358 | A | 6/1897 | Gould |
| 697,336 | A | 4/1902 | Hagerty |
| 726,727 | A | 4/1903 | Mills |
| 864,054 | A | 8/1907 | Abrams |
| 907,842 | A | 12/1908 | Meuzies |
| 1,002,468 | A | 9/1911 | Strangman |
| 1,006,630 | A | 10/1911 | Clarke |

(Continued)

FOREIGN PATENT DOCUMENTS

| | | |
|---|---|---|
| CH | 99738 | 6/1923 |

(Continued)

OTHER PUBLICATIONS

European Search Report dated Mar. 11, 2008.

(Continued)

*Primary Examiner* — Shay L Karls
(74) *Attorney, Agent, or Firm* — Judy W. Chung

(57) ABSTRACT

A toothbrush includes a head and a plurality of tooth cleaning elements for enhanced cleaning of the teeth. The tooth cleaning elements include cleaning elements that define a loop arrangement for better retention of the dentifrice, a central cleaning element disposed within the loop, two opposing arcuate cleaning elements disposed on opposite sides of the loop, peripheral cleaning element with a stepped and tapered construction, elongate distal cleaning elements, and proximal cleaning elements.

20 Claims, 5 Drawing Sheets

U.S. PATENT DOCUMENTS

| | | | |
|---|---|---|---|
| 1,125,532 | A | 1/1915 | Himmel |
| 1,128,138 | A | 2/1915 | Hoffman |
| 1,128,139 | A | 2/1915 | Hoffman |
| 1,142,698 | A | 6/1915 | Grove et al. |
| 1,153,409 | A | 9/1915 | Wheeler |
| 1,168,823 | A | 1/1916 | Plank |
| 1,188,823 | A | 6/1916 | Plank |
| 1,191,556 | A | 7/1916 | Blake |
| 1,251,250 | A | 12/1917 | Libby |
| 1,268,544 | A | 6/1918 | Cates |
| 1,297,272 | A | 3/1919 | Strang et al. |
| 1,405,279 | A | 7/1922 | Cassedy |
| 1,470,710 | A | 10/1923 | Davis |
| 1,495,675 | A | 5/1924 | Colt |
| 1,526,267 | A | 2/1925 | Dessau |
| 1,578,074 | A | 3/1926 | Chandler |
| 1,588,785 | A | 6/1926 | Van Sant |
| 1,598,224 | A | 8/1926 | Van Sant |
| 1,658,706 | A | 2/1928 | Carrott |
| 1,704,564 | A | 3/1929 | Friedland |
| 1,705,109 | A | 3/1929 | Essbach |
| 1,728,956 | A | 9/1929 | Damitzel |
| 1,741,143 | A | 12/1929 | Chin |
| 1,816,582 | A | 7/1931 | Heron |
| 1,817,585 | A | 8/1931 | Samuel |
| 1,852,480 | A | 4/1932 | Ruetz |
| 1,860,924 | A | 5/1932 | Cooke |
| 1,861,347 | A | 5/1932 | Johnson |
| 1,872,832 | A | 8/1932 | Silverberg |
| 1,891,864 | A | 12/1932 | Barrett |
| 1,892,068 | A | 12/1932 | Metzler |
| 1,903,161 | A | 3/1933 | Barkan |
| 1,910,414 | A | 5/1933 | Varga |
| 1,924,152 | A | 8/1933 | Coney et al. |
| 2,083,217 | A | 7/1934 | Brother et al. |
| 1,993,662 | A | 3/1935 | Green |
| 1,993,763 | A | 3/1935 | Touchstone |
| D99,352 | S | 4/1936 | Grapp |
| 2,042,239 | A | 5/1936 | Planding |
| 2,049,956 | A | 8/1936 | Greenberg |
| 2,059,914 | A | 11/1936 | Rosenberg |
| 2,079,728 | A | 5/1937 | Arnold |
| 2,088,839 | A | 8/1937 | Coney et al. |
| 2,117,174 | A | 5/1938 | Jones |
| 2,139,245 | A | 12/1938 | Ogden |
| 2,140,307 | A | 12/1938 | Belaschk et al. |
| 2,154,846 | A | 4/1939 | Heymann et al. |
| 2,161,349 | A | 6/1939 | Hadden |
| 2,186,005 | A | 1/1940 | Casto |
| D122,815 | S | 10/1940 | Crosby |
| 2,218,072 | A | 10/1940 | Runnels |
| 2,219,753 | A | 10/1940 | Seguin |
| 2,225,331 | A | 12/1940 | Campbell |
| 2,233,936 | A | 3/1941 | Campbell |
| 2,244,699 | A | 6/1941 | Hosey |
| 2,253,210 | A | 8/1941 | Psiharis |
| 2,253,910 | A | 8/1941 | Luenz |
| 2,263,802 | A | 11/1941 | Grusin |
| 2,279,355 | A | 4/1942 | Wilensky |
| 2,305,461 | A | 12/1942 | Spyra |
| 2,312,828 | A | 3/1943 | Adamsson |
| 2,364,205 | A | 12/1944 | Fuller et al. |
| 2,405,029 | A | 7/1946 | Gallanty et al. |
| 2,418,485 | A | 4/1947 | Shipley |
| 2,443,461 | A | 6/1948 | Kempster |
| 2,491,274 | A | 12/1949 | McNeill |
| 2,512,059 | A | 6/1950 | Haeusser |
| 2,651,068 | A | 11/1950 | Seko |
| 2,543,999 | A | 3/1951 | Voss |
| 2,545,814 | A | 3/1951 | Kempster |
| D162,941 | S | 4/1951 | Ehrman |
| 2,554,777 | A | 5/1951 | Dangin |
| 2,574,654 | A | 11/1951 | Moore |
| 2,583,750 | A | 1/1952 | Runnels |
| 2,637,870 | A | 5/1953 | Cohen |
| 2,642,604 | A | 6/1953 | Ferrari |
| 2,708,762 | A | 6/1953 | Kling et al. |
| 2,686,325 | A | 8/1954 | Silver |
| 2,702,914 | A | 3/1955 | Kittle et al. |
| 3,103,027 | A | 9/1963 | Birch |
| 3,103,680 | A | 9/1963 | Krichmar |
| 3,153,800 | A | 10/1964 | Trotin |
| 3,181,193 | A | 5/1965 | Nobles et al. |
| 3,195,537 | A | 7/1965 | Blasi |
| 3,230,562 | A | 1/1966 | Birch |
| 3,254,356 | A | 6/1966 | Yao et al. |
| 3,258,805 | A | 7/1966 | Rossnan |
| 3,261,354 | A | 7/1966 | Shpuntoff |
| 3,315,296 | A | 4/1967 | Richardson |
| 3,337,893 | A | 8/1967 | Fine et al. |
| 3,359,588 | A | 12/1967 | Kobler |
| 3,491,396 | A | 1/1970 | Eannarino et al. |
| 3,509,874 | A | 5/1970 | Stillman |
| 3,553,759 | A | 1/1971 | Kramer et al. |
| 3,610,043 | A | 10/1971 | Wemyss |
| 3,633,237 | A | 1/1972 | Bagube |
| 3,638,270 | A | 2/1972 | Schlegel, Jr. et al. |
| 3,939,522 | A | 2/1976 | Shimizu |
| 4,128,910 | A | 12/1978 | Nakata et al. |
| 4,249,521 | A | 2/1981 | Gueret |
| 4,277,862 | A | 7/1981 | Weideman |
| 4,292,705 | A | 10/1981 | Stouffer |
| 4,299,208 | A | 11/1981 | Bianc |
| 4,328,604 | A | 5/1982 | Adams |
| 4,356,585 | A | 11/1982 | Protell et al. |
| 4,364,142 | A | 12/1982 | Pangle |
| D272,683 | S | 2/1984 | Stocchi |
| D272,687 | S | 2/1984 | Stocchi |
| D272,689 | S | 2/1984 | Stocchi |
| D272,690 | S | 2/1984 | Stocchi |
| D273,635 | S | 5/1984 | Stocchi |
| 4,455,704 | A | 6/1984 | Williams |
| 4,461,285 | A | 7/1984 | Courtin |
| 4,486,109 | A | 12/1984 | Rosofsky |
| 4,488,327 | A | 12/1984 | Snider |
| 4,493,125 | A | 1/1985 | Collis |
| 4,573,920 | A | 3/1986 | d'Argembeau |
| 4,592,108 | A | 6/1986 | Svendsen |
| 4,607,411 | A | 8/1986 | Lewis, Jr. |
| 4,610,043 | A | 9/1986 | Vezjak |
| 4,628,564 | A | 12/1986 | Youssef |
| D295,695 | S | 5/1988 | Golzari |
| 4,827,551 | A | 5/1989 | Maser et al. |
| 4,827,557 | A | 5/1989 | Siler, Jr. et al. |
| 4,888,844 | A | 12/1989 | Maggs |
| D309,528 | S | 7/1990 | Valenti |
| 5,005,246 | A | 4/1991 | Yen-Hul |
| 5,027,796 | A | 7/1991 | Linzey |
| 5,032,082 | A | 7/1991 | Herrera |
| 5,040,260 | A | 8/1991 | Michaels |
| 5,120,225 | A | 6/1992 | Amit |
| 5,165,761 | A | 11/1992 | Dirksing |
| 5,170,525 | A | 12/1992 | Cafaro |
| 5,176,427 | A | 1/1993 | Weihrauch |
| 5,211,494 | A | 5/1993 | Baijnath |
| 5,226,197 | A | 7/1993 | Nack et al. |
| 5,230,118 | A | 7/1993 | Chamma |
| 5,242,235 | A | 9/1993 | Li |
| 5,249,327 | A | 10/1993 | Hing |
| D340,808 | S | 11/1993 | Sherman et al. |
| 5,273,425 | A | 12/1993 | Hoagland |
| D345,256 | S | 3/1994 | Khin |
| 5,305,489 | A | 4/1994 | Lage |
| 5,313,909 | A | 5/1994 | Tseng et al. |
| 5,335,389 | A | 8/1994 | Curtis et al. |
| 5,341,537 | A | 8/1994 | Curtis et al. |
| 5,353,460 | A | 10/1994 | Bauman |
| 5,373,600 | A | 12/1994 | Stojanovski et al. |
| 5,392,483 | A | 2/1995 | Heinzelman et al. |
| 5,396,678 | A | 3/1995 | Bredall et al. |
| 5,398,369 | A | 3/1995 | Heinzelman et al. |
| 5,438,726 | A | 8/1995 | Leite |
| 5,445,825 | A | 8/1995 | Copelan et al. |
| 5,446,940 | A | 9/1995 | Curtis et al. |
| 5,467,495 | A | 11/1995 | Boland et al. |
| 5,511,273 | A | 4/1996 | Carroll |
| D371,680 | S | 7/1996 | Juhlin et al. |

5,530,981 A 7/1996 Chen
5,535,474 A 7/1996 Salazar
5,570,487 A 11/1996 Schneider
D376,695 S 12/1996 Tveras
5,584,690 A 12/1996 Maassarani
5,604,951 A * 2/1997 Shipp ..... 15/167.1
5,613,262 A 3/1997 Choy-Maldonado
5,625,916 A 5/1997 McDougall
5,628,082 A 5/1997 Moskovich
D386,905 S 12/1997 Brady et al.
5,709,004 A 1/1998 Paduano et al.
D391,769 S 3/1998 Kling et al.
5,729,858 A 3/1998 Riffel
5,735,011 A 4/1998 Asher
5,735,012 A 4/1998 Heinzelman et al.
5,735,864 A 4/1998 Heisinger, Jr.
5,742,972 A * 4/1998 Bredall et al. ..... 15/167.1
5,758,380 A 6/1998 Vrignaud
5,766,193 A 6/1998 Millner
D396,288 S 7/1998 Samuel
5,778,475 A 7/1998 Garcia
5,778,476 A 7/1998 Squillaci et al.
5,779,654 A 7/1998 Foley et al.
5,784,742 A 7/1998 Giuliani et al.
D397,219 S 8/1998 Rangel et al.
5,792,159 A 8/1998 Armin
5,799,353 A 9/1998 Oishi et al.
5,802,656 A 9/1998 Dawson et al.
5,806,127 A 9/1998 Samoil et al.
5,809,608 A 9/1998 Zadro
5,810,856 A 9/1998 Tveras
D399,349 S 10/1998 Barth
5,817,114 A 10/1998 Anderson et al.
5,818,856 A 10/1998 Injeyan et al.
RE35,941 E 11/1998 Stansbury, Jr.
D402,116 S 12/1998 Magloff et al.
5,842,245 A 12/1998 Pai et al.
5,842,247 A 12/1998 Decesare et al.
5,845,358 A 12/1998 Woloch
D403,510 S 1/1999 Menke et al.
5,860,183 A 1/1999 Kam
D405,272 S 2/1999 Khlaj et al.
5,873,140 A 2/1999 Holloway
5,875,510 A 3/1999 Lamond et al.
5,896,614 A 4/1999 Flewitt
5,913,346 A 6/1999 Narwani
5,915,433 A 6/1999 Hybler
D412,064 S 7/1999 Achepohl et al.
5,920,941 A 7/1999 Iannotta
5,928,254 A 7/1999 Jensen
5,930,860 A 8/1999 Shipp
5,930,861 A 8/1999 White
5,938,673 A 8/1999 DePierro et al.
D413,728 S 9/1999 Waguespack et al.
5,946,759 A 9/1999 Cann
5,951,578 A 9/1999 Jensen
5,957,942 A 9/1999 Yudelman
5,967,152 A 10/1999 Rimkus
5,970,564 A 10/1999 Inns et al.
D416,685 S 11/1999 Overthun
5,974,614 A 11/1999 Ross
5,980,541 A 11/1999 Tenzer
5,980,542 A 11/1999 Saldivar
5,984,935 A 11/1999 Welt et al.
5,991,959 A 11/1999 Raven et al.
D418,979 S 1/2000 Moskovich et al.
D418,981 S 1/2000 Cheong et al.
D419,304 S 1/2000 Moskovich et al.
6,015,293 A 1/2000 Rimkus
D419,773 S 2/2000 Beals et al.
D420,802 S 2/2000 Cheong et al.
D420,804 S 2/2000 Juhlin et al.
6,029,304 A 2/2000 Hulke et al.
D421,841 S 3/2000 Achepohl et al.
6,032,315 A 3/2000 Liebel
6,041,467 A 3/2000 Roberts et al.
6,041,468 A 3/2000 Chen et al.
D422,143 S 4/2000 Beals et al.
D422,413 S 4/2000 Goldinger et al.
6,044,514 A 4/2000 Kaneda et al.
D423,785 S 5/2000 Karallis
D423,786 S 5/2000 Zelinski
D423,787 S 5/2000 Musciano
D424,808 S 5/2000 Beals et al.
D424,809 S 5/2000 Bernard
D425,306 S 5/2000 Beals et al.
6,058,541 A 5/2000 Masterman et al.
6,065,176 A 5/2000 Watanabe et al.
6,067,684 A 5/2000 Kweon
D427,437 S 7/2000 Vonarburg
6,098,233 A 8/2000 Chen
6,105,191 A 8/2000 Chen et al.
6,108,851 A 8/2000 Bredall et al.
6,108,869 A 8/2000 Meessmann et al.
6,119,296 A 9/2000 Noe et al.
6,131,228 A 10/2000 Chen et al.
6,151,745 A 11/2000 Roberts et al.
D434,906 S 12/2000 Beals et al.
6,168,434 B1 1/2001 Bohm-Van Diggelen
6,171,323 B1 1/2001 Potti et al.
6,182,365 B1 2/2001 Tseng et al.
D439,412 S 3/2001 Volpenhein et al.
D440,767 S 4/2001 Moskovich et al.
D440,787 S 4/2001 Moskovich et al.
6,254,390 B1 7/2001 Wagner
6,260,227 B1 7/2001 Fulop et al.
6,276,021 B1 8/2001 Holhbien
D448,174 S 9/2001 Harris et al.
6,289,545 B1 9/2001 Molster
D448,569 S 10/2001 Harris et al.
D450,299 S 11/2001 Ma et al.
D450,457 S 11/2001 Hohlbein
D450,929 S 11/2001 Angelini et al.
6,311,358 B1 11/2001 Soetewey et al.
6,319,332 B1 11/2001 Gavney, Jr. et al.
6,322,573 B1 11/2001 Murayama
D452,615 S 1/2002 Cheong et al.
D453,270 S 2/2002 Choong
6,345,405 B1 2/2002 Brackin
D453,998 S 3/2002 Ping
D454,252 S 3/2002 Lee
6,352,545 B1 3/2002 Wagner
6,353,958 B2 3/2002 Welhrauch
RE37,625 E 4/2002 Wieder et al.
D456,139 S 4/2002 Hohlbein
6,374,448 B2 4/2002 Seifert
D456,607 S 5/2002 Carlucci et al.
D457,323 S 5/2002 Hohlbein
D457,325 S 5/2002 Wilson et al.
6,383,202 B1 5/2002 Rosenblood
6,389,634 B1 5/2002 Devlin et al.
D458,453 S 6/2002 Baertschi
D459,086 S 6/2002 Belton et al.
6,402,768 B1 6/2002 Liebel
6,408,476 B1 6/2002 Cann
6,421,867 B1 7/2002 Weihrauch
D461,313 S 8/2002 Hohlbein
D461,959 S 8/2002 Chan et al.
D462,178 S 9/2002 Moskovich et al.
D462,528 S 9/2002 Crossman et al.
D463,132 S 9/2002 Winter et al.
D463,133 S 9/2002 Hohlbein
6,442,785 B1 9/2002 Robinson
6,446,295 B1 9/2002 Calabrese
6,625,839 B2 9/2002 Fischer
D463,668 S 10/2002 Yoshimoto et al.
6,463,618 B1 10/2002 Zimmer
6,463,619 B2 10/2002 Gavney, Jr.
D465,847 S 11/2002 Jacobs
D465,927 S 11/2002 Saindon et al.
D466,302 S 12/2002 Ping
D466,303 S 12/2002 Saindon et al.
D466,694 S 12/2002 Saindon et al.
6,496,999 B1 12/2002 Gleason et al.
6,510,575 B2 1/2003 Calabrese et al.
D469,958 S 2/2003 Saindon et al.
6,513,182 B1 2/2003 Calabrese et al.
D471,362 S 3/2003 Moskovich et al.

| | | | |
|---|---|---|---|
| D471,276 | S | 4/2003 | Potti |
| 6,546,586 | B2 | 4/2003 | Cho |
| D474,608 | S | 5/2003 | Hohlbein |
| D475,531 | S | 6/2003 | Kilmeck et al. |
| D476,158 | S | 6/2003 | Ling |
| 6,571,417 | B1 | 6/2003 | Gavney, Jr. |
| D478,213 | S | 8/2003 | Ping |
| D478,424 | S | 8/2003 | Saindon et al. |
| D478,425 | S | 8/2003 | Ping |
| D478,727 | S | 8/2003 | Wong |
| D479,046 | S | 9/2003 | Winkler |
| D479,047 | S | 9/2003 | Wong |
| D479,914 | S | 9/2003 | Choong |
| D480,213 | S | 10/2003 | Ping |
| D480,562 | S | 10/2003 | Saindon et al. |
| D482,199 | S | 11/2003 | De Salvo |
| 6,643,886 | B2 * | 11/2003 | Moskovich et al. ..... 15/167.1 |
| 6,647,581 | B1 | 11/2003 | Persad et al. |
| D483,183 | S | 12/2003 | De Salvo |
| D483,184 | S | 12/2003 | Geiberger et al. |
| D483,568 | S | 12/2003 | Jamson |
| 6,654,979 | B2 | 12/2003 | Calabrese |
| 6,658,688 | B2 | 12/2003 | Gavney, Jr. |
| 6,665,901 | B2 | 12/2003 | Driesen et al. |
| D486,649 | S | 2/2004 | Sprosta et al. |
| 6,687,940 | B1 | 2/2004 | Gross et al. |
| D487,195 | S | 3/2004 | Winkler |
| 6,729,789 | B2 | 5/2004 | Gordon |
| 6,735,804 | B2 | 5/2004 | Carlucci et al. |
| 6,817,054 | B2 | 11/2004 | Moskovich et al. |
| 6,859,969 | B2 * | 3/2005 | Gavney et al. ..... 15/117 |
| 6,886,207 | B1 | 5/2005 | Solanki |
| 6,895,629 | B1 | 5/2005 | Wenzler |
| 7,089,621 | B2 | 8/2006 | Hohlbein |
| D503,538 | S | 4/2007 | Desalvo |
| 7,213,288 | B2 | 5/2007 | Hohlbein |
| 7,428,766 | B2 | 9/2008 | Eliav et al. |
| 2001/0023516 | A1 | 9/2001 | Driesen et al. |
| 2001/0014232 | A1 | 11/2001 | Ichimura |
| 2001/0041903 | A1 | 11/2001 | Richard |
| 2001/0042280 | A1 | 11/2001 | Moskovich et al. |
| 2002/0004964 | A1 | 1/2002 | Luchino et al. |
| 2002/0019645 | A1 | 2/2002 | Fischer et al. |
| 2002/0029988 | A1 | 3/2002 | Blaustein et al. |
| 2002/0032941 | A1 | 3/2002 | Blaustein et al. |
| 2002/0059685 | A1 | 5/2002 | Paffrath |
| 2002/0095734 | A1 | 7/2002 | Wong |
| 2002/0108194 | A1 | 8/2002 | Cartucci et al. |
| 2002/0124333 | A1 | 9/2002 | Hafliger et al. |
| 2002/0124337 | A1 | 9/2002 | Calabrese et al. |
| 2002/0138926 | A1 | 10/2002 | Brown, Jr. et al. |
| 2002/0138928 | A1 | 10/2002 | Calabrese et al. |
| 2002/0152564 | A1 | 10/2002 | Blaustein et al. |
| 2002/0162180 | A1 | 11/2002 | Blaustein et al. |
| 2003/0009837 | A1 | 1/2003 | Cann |
| 2003/0026738 | A1 | 2/2003 | Everett |
| 2003/0033680 | A1 | 2/2003 | Davies et al. |
| 2003/0033682 | A1 | 2/2003 | Davies et al. |
| 2003/0115699 | A1 | 6/2003 | Wagstaff |
| 2003/0116884 | A1 | 6/2003 | Wagstaff |
| 2003/0163149 | A1 | 8/2003 | Heisinger, Jr. |
| 2003/0167582 | A1 | 9/2003 | Fischer et al. |
| 2003/0192139 | A1 | 10/2003 | Fattori et al. |
| 2003/0196283 | A1 | 10/2003 | Eliav et al. |
| 2003/0108865 | A1 | 11/2003 | Davies |
| 2003/0208865 | A1 | 11/2003 | Davies |
| 2003/0216762 | A1 | 11/2003 | Levit |
| 2003/0229959 | A1 | 12/2003 | Gavney et al. |
| 2004/0006837 | A1 | 1/2004 | Cann |
| 2004/0025275 | A1 | 2/2004 | Moskovich et al. |
| 2004/0068810 | A1 | 4/2004 | Lee |
| 2004/0134007 | A1 | 7/2004 | Davies |
| 2004/0200748 | A1 | 10/2004 | Klassen et al. |
| 2004/0255416 | A1 | 12/2004 | Hohlbein |
| 2005/0000049 | A1 | 1/2005 | Hohlbein |
| 2005/0069372 | A1 | 3/2005 | Hohlbein et al. |
| 2006/0057087 | A1 | 3/2006 | Moskovich et al. |

FOREIGN PATENT DOCUMENTS

| | | | |
|---|---|---|---|
| CN | 992257042 | | 11/1999 |
| DE | 857128 | | 11/1952 |
| DE | 2930459 | | 2/1981 |
| DE | 3114507 | | 3/1983 |
| DE | 3428860 | | 2/1986 |
| DE | 3639424 | | 6/1988 |
| EP | 360 766 | | 3/1990 |
| EP | 0449655 | | 5/1995 |
| EP | 0449655 | B1 | 5/1995 |
| EP | 0875169 | | 4/1998 |
| EP | 1034721 | | 9/2000 |
| EP | 1306108 | | 5/2003 |
| EP | 1308108 | | 5/2003 |
| EP | 1425989 | | 6/2004 |
| FR | 537979 | | 6/1922 |
| FR | 2594307 | | 4/1987 |
| FR | 2636818 | | 9/1988 |
| FR | 2793136 | | 11/2000 |
| GB | 17643 | | 4/1912 |
| GB | 388246 | | 2/1933 |
| GB | 495982 | | 11/1938 |
| GB | 2371217 | | 7/2002 |
| GB | 2391462 | | 2/2004 |
| GB | 2375705 | | 1/2005 |
| JP | 51 35303 | | 8/1976 |
| JP | 6-14709 | | 1/1994 |
| JP | 9-182626 | | 7/1997 |
| JP | 10-42957 | | 2/1998 |
| JP | 2000-000118 | | 1/2000 |
| JP | 2000-278899 | | 10/2000 |
| JP | 2000-308522 | | 11/2000 |
| JP | 2001-1314232 | | 11/2001 |
| JP | 2002-142867 | | 5/2002 |
| SU | 1708283 | | 1/1992 |
| WO | WO 98/18364 | | 5/1914 |
| WO | WO 96/01578 | | 1/1996 |
| WO | WO 96/15696 | | 5/1996 |
| WO | WO 96/28994 | | 9/1996 |
| WO | WO 97/03587 | | 2/1997 |
| WO | WO 97/04686 | | 2/1997 |
| WO | WO 97/25898 | | 7/1997 |
| WO | WO 98/05241 | | 2/1998 |
| WO | WO 98/08458 | | 3/1998 |
| WO | WO 98/09573 | | 3/1998 |
| WO | WO 98/22000 | | 5/1998 |
| WO | WO 99/01054 | | 1/1999 |
| WO | WO 99/07251 | | 2/1999 |
| WO | WO 99/37182 | | 7/1999 |
| WO | 9945819 | A | 9/1999 |
| WO | WO 99/45819 | | 9/1999 |
| WO | WO 99/49754 | | 10/1999 |
| WO | WO 00/53054 | | 9/2000 |
| WO | WO 00/64307 | | 11/2000 |
| WO | WO 01/01817 | | 1/2001 |
| WO | WO 01/17433 | | 3/2001 |
| WO | WO 01/45573 | | 6/2001 |
| WO | WO 01/80686 | | 11/2001 |
| WO | WO 02/45617 | | 6/2002 |
| WO | WO 02/062174 | | 8/2002 |
| WO | WO 02/071967 | | 9/2002 |
| WO | WO 03/030680 | | 4/2003 |
| WO | WO 2004/019801 | | 3/2004 |
| WO | WO 2004/026162 | | 4/2004 |
| WO | WO 2004/028235 | | 4/2004 |
| WO | WO 2006/044964 | | 4/2006 |

OTHER PUBLICATIONS

European Search Report from the European Patent Office dated Mar. 11, 2008.

Abstract of Japanese patent application publication 2000-000118 published Jan. 2000.

* cited by examiner

TOOTHBRUSH

CROSS-REFERENCE TO RELATED APPLICATIONS

This application is a continuation of co-pending U.S. patent application Ser. No. 10/870,462, filed Jun. 18, 2004, which is a continuation-in-part of co-pending U.S. patent application Ser. No. 10/601,106 filed Jun. 20, 2003, entitled "Toothbrush with Tongue Cleaning Member," a continuation-in-part of co-pending U.S. PCT Application Serial No. PCT/US2003/030633 (designating the U.S.) filed Sep. 26, 2003, entitled "Toothbrush" , which claims priority to U.S. Patent Application 60/414,117, filed Sep. 27, 2002 (now abandoned), U.S. Patent Application 60/418,776, filed Oct. 16, 2002 (now abandoned), and U.S. Patent Application No. 60/419,425, filed Oct. 18, 2002 (now abandoned), and is a continuation-in-part of co-pending PCT Patent Application No. PCT/US2003/029497 (designating the U.S.), filed Sep. 17, 2003, entitled "Toothbrush With Gripping Area", which claims priority to U.S. Provisional Patent Application Ser. No. 60/412,290, filed Sep. 20, 2002 (now abandoned), and is a continuation in part of co-pending U.S. patent application Ser. No. 29/189,729, filed Sep. 10, 2003. This application is also related to co-pending U.S. patent application Ser. No. 10/879,922 entitled "Oral Care Implement" filed on Jun. 18, 2004. The contents of the above-noted applications are each expressly incorporated herein by reference.

FIELD OF THE INVENTION

The present invention pertains to a toothbrush with an enhanced cleaning head.

BACKGROUND OF THE INVENTION

A toothbrush is used to clean the teeth by removing plaque and debris from the tooth surfaces. Conventional toothbrushes provided with a flat bristle trim are limited in their ability to conform to the curvature of the teeth, to penetrate into the interproximal areas between the teeth, to sweep away the plaque and debris, and to clean along the gum line. Additionally, such toothbrushes have a limited ability to retain dentifrice for cleaning the teeth. During the brushing process, the dentifrice typically slips through the tufts of bristles and away from the contact between the bristles and teeth. As a result, the dentifrice often is spread around the mouth, rather than being concentrated on the contact of the bristles with the teeth. Therefor, the efficiency of the cleaning process is reduced.

SUMMARY OF THE INVENTION

The invention pertains to a toothbrush with a novel arrangement of cleaning elements to provide superior cleaning of the teeth.

In one aspect of the invention, a toothbrush includes a head having a plurality of tooth cleaning elements extending from a base surface. The tooth cleaning elements generally define a loop arrangement to better retain the dentifrice proximate to the contact between the bristles and the teeth for more effective cleaning. In one preferred construction, each loop is formed by a plurality of independently flexible cleaning elements so as to maintain user comfort and provide improved cleaning of the teeth.

In another aspect of the invention, other cleaning elements are disposed within the cleaning elements forming the loop.

In this construction, these central cleaning elements are strategically located to maximize the cleaning effect of the retained dentifrice.

In another aspect of the invention, tooth cleaning elements are positioned along the periphery of the head. In one preferred construction, these peripheral cleaning elements are stepped and tapered to clean along the gum line and reach the interproximal areas between the teeth.

The present invention also pertains to combinations of different kinds of cleaning elements on a single head that cooperate to provide a pattern for overall improved cleaning of the teeth, including effective cleaning of the rear teeth, the interproximal areas between the teeth, along the gum line, and the lingual and facial side surfaces of the teeth.

BRIEF DESCRIPTION OF THE DRAWINGS

A more complete understanding of the present invention and the advantages thereof may be acquired by referring to the following description in consideration of the accompanying drawings, in which like reference numbers indicate like features, and wherein.

DETAILED DESCRIPTION OF THE INVENTION

Figure 1:
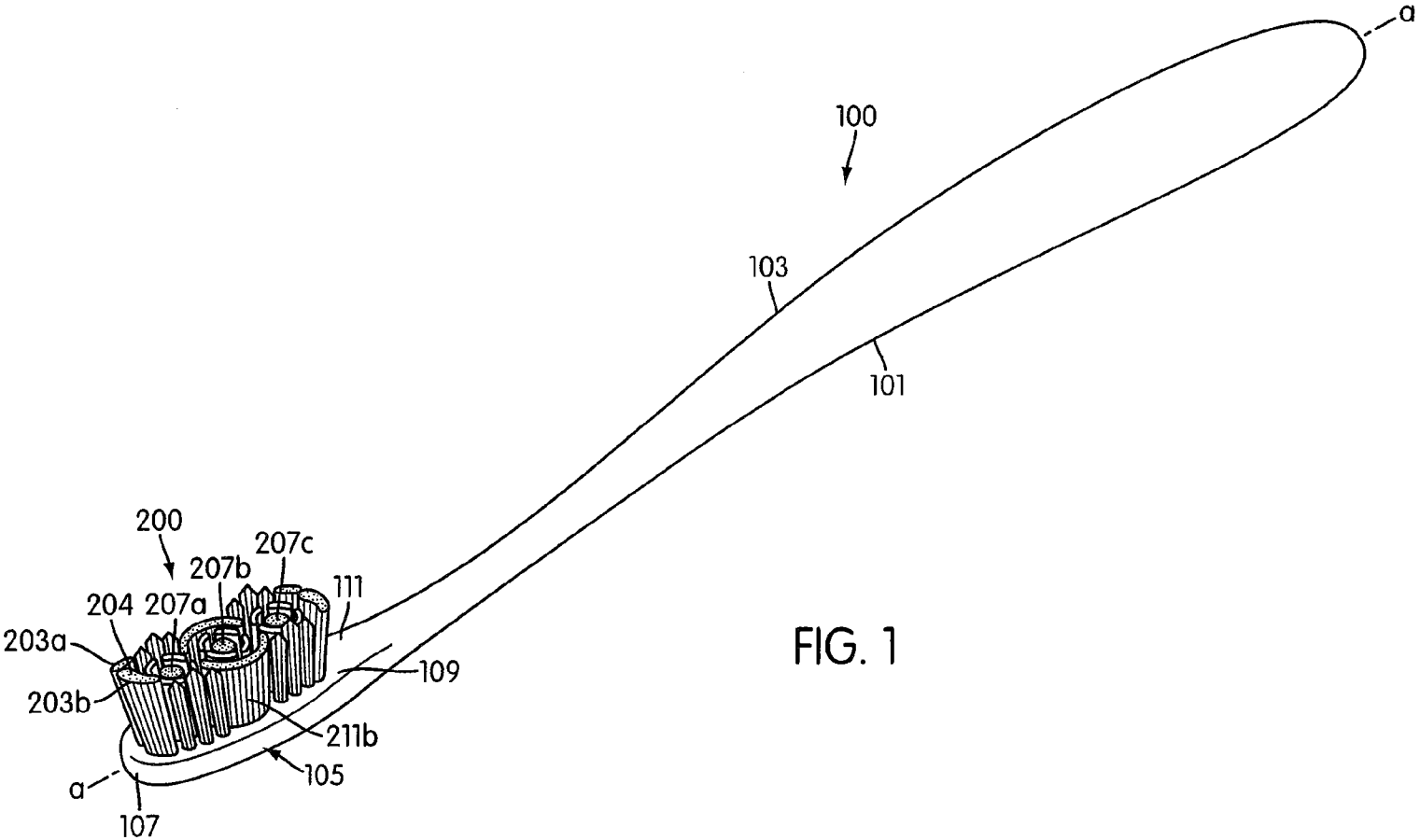
FIG. 1 is a perspective view of a toothbrush according to one or more aspects of an illustrative embodiment.

FIGS. 1-7 illustrate a toothbrush 100 having a support 101 including a handle 103 and a head 105, and tooth cleaning elements 200 for cleaning the user's teeth. Handle 103 is provided for the user to readily grip and manipulate the toothbrush 100, and may be formed of many different shapes and with a variety of constructions. Head 105 is the end portion of the support provided with tooth cleaning elements 200. The tooth cleaning elements can be attached to a base surface 109 of head 105 by any known means.

In a preferred construction, base surface 109 is provided with at least one group of cleaning elements 209 that collectively define a loop configuration 214 to better retain dentifrice among the tooth cleaning elements 200 and specifically between the contact of the cleaning elements and the teeth. While the loop configuration is preferably a circle, it could be in the form of a myriad of different closed loops including without limitation ovals, squares and irregular shapes. It is believed that the use of interior concave wall surfaces within the loop will best retain and move the dentifrice on the teeth especially when the toothbrush is generally moved in the desired small circular motions to brush the teeth. Nevertheless, other shapes can be used. The loop should simply define a substantially closed configuration to retain the dentifrice.

Figure 2:
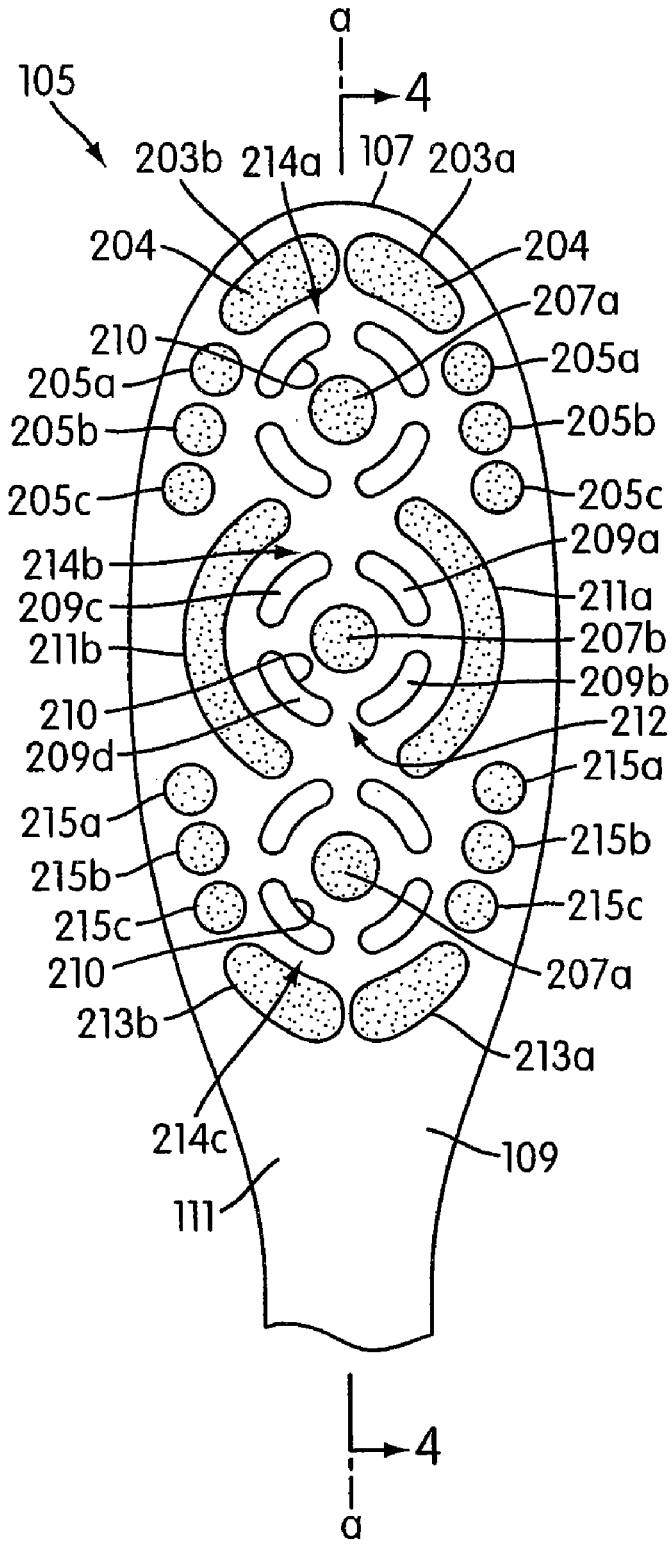
FIG. 2 is an enlarged plan view of a head section of the toothbrush of FIG. 1.

To better retain the dentifrice, each loop configuration is preferably defined by cleaning elements composed of elastomeric wall members. Although the loop configurations could be formed by tightly packed, elongate bristle tufts, such arrangements will permit a greater escape of the dentifrice than the elastomeric wall members. Further, although the loop configurations could be completely closed structures, they are preferably only substantially closed and each formed by a plurality of independently flexible cleaning elements 209*a-d*. In this way, the cleaning elements are able to provide a limited and controlled flow of the dentifrice to the outer cleaning elements and maintain sufficient flexibility to provide greater user comfort and improved cleaning by elements 209. In the preferred construction, as seen in FIG. 2, each loop construction is defined by four elastomeric wall members 209*a-d* each defining an arc segment that is approximately a quarter of a circle. As noted above, adjacent arc segments are spaced apart to define gaps 212 that permit a limited outward flow of dentifrice and independent flexing of each wall member. The gaps also aid the cleaning of cleaning elements 209 by permitting water to flush through the loops. The gaps, however, are preferably kept small to limit the escape of the dentifrice. While four segments have been illustrated to define each loop, other numbers of segments could be used. The wall members can be formed of any elastomeric material known for use as tooth cleaning elements. Finally, although the arc segments are preferably independent cleaning members, the loop could also be formed as a single member provided with slits to define gaps 212 and independently flexible cleaning elements 209*a-d*.

As best seen in FIG. 2, the preferred embodiment includes three loops 214*a-c* that are each positioned front to back along longitudinal axis a-a. In this way, a large portion of the dentifrice applied to the tooth cleaning elements can be retained to clean the user's teeth. Nevertheless, one, two or more than three loops could be used. Moreover, the loops could be arranged in other patterns including non-aligned arrangements or positioned off of axis a-a.

In a preferred construction, a central cleaning element 207 is disposed within each loop 214; although more than one central cleaning element 207 could be provided within each loop when larger loops are used. With this arrangement, dentifrice stays near the tips of cleaning elements 207 during a brushing operation for efficient cleaning. In the preferred construction, the concave nature of the inside surfaces of cleaning elements 209*a-d* directs the dentifrice to cleaning elements 207*a-c* during the sweeping or oscillating motion of head 105.

Central cleaning elements 207 are each preferably formed as bristle tufts for effectively cleaning the teeth. Nevertheless, one or more elastomer members may be used to form the distal cleaning elements in lieu of or in addition to the use of bristles.

The bristles of cleaning elements 203 as well as the bristles of other tufts discussed below are preferably composed of a nylon made from a material such as, for example, a nylon material marketed by Dupont under the name BRILLIANCE. Nevertheless, other materials could be used. The bristles in toothbrush 100 also preferably have a circular cross-sectional shape, but could have other cross-sections as well. The round bristles in toothbrush may be composed on a nylon marketed by Dupont under the name of TYNEX. The diameter of the round bristles are preferably 0.007 inches-0.008 inches thick or have other thicknesses depending on the desired cleaning action of the bristles. The tooth cleaning elements are connected to the toothbrush using known manufacturing methods for oral care products.

With reference to FIGS. 1 and 2, an additional outer ring of cleaning elements 211*a*, 211*b* is disposed in a central region of head 105 in a generally arcuate arrangement about cleaning elements 209*a-d* of central loop 214*b*. These outer arcuate cleaning elements 211*a-b* are preferably defined by two opposing arcuate cleaning elements which are arranged generally symmetrical on each side of the longitudinal axis a-a of head 105. As shown in FIG. 2, the outer cleaning elements 211*a-b* surround the loop cleaning elements 209*a-d* in the central region of head 105 to effectively use this space on the head. In a preferred arrangement, the loop cleaning elements 209*a-d* in the central region may be disposed generally concentrically within outer cleaning elements 211*a-b*. The dentifrice flowing through gaps 212 in the sides of loop 214*b* will be used by outer cleaning elements 211. While the outer arcuate cleaning elements 211*a, b* are preferably defined by elongate bristle tufts for effective brushing of the teeth, they could be formed of one or more elastomeric members in lieu of or in addition to the bristles.

Figure 4:
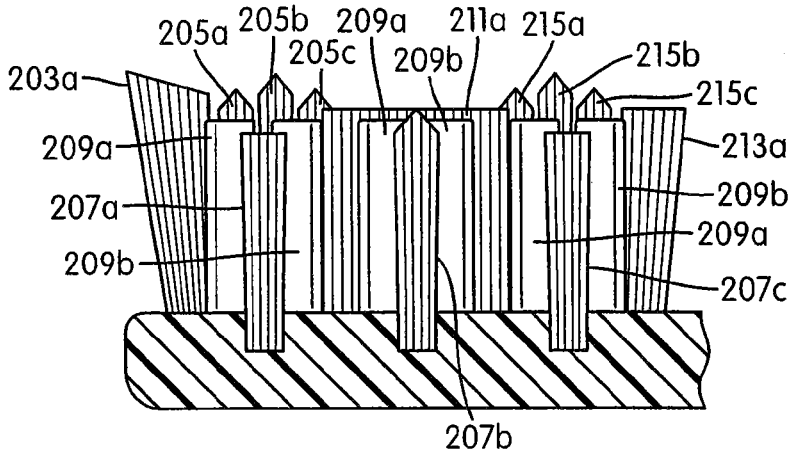
FIG. 4 is a section view of the head section taken along line 4-4 in FIG. 2.
Figure 5:
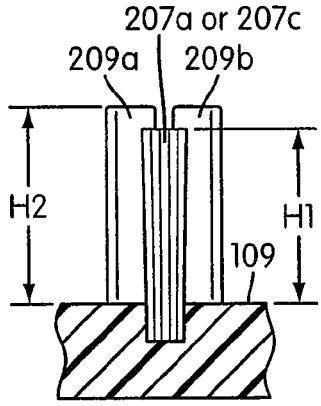
FIG. 5 is a partial section view of the head section similar to FIG. 4 showing a tooth cleaning element arrangement in isolation for clarity.
Figure 6:
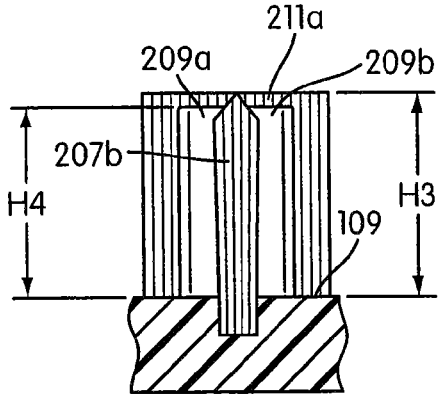
FIG. 6 is a partial section view of the head section similar to FIG. 4 showing another tooth cleaning element arrangement in isolation for clarity.
Figure 7:
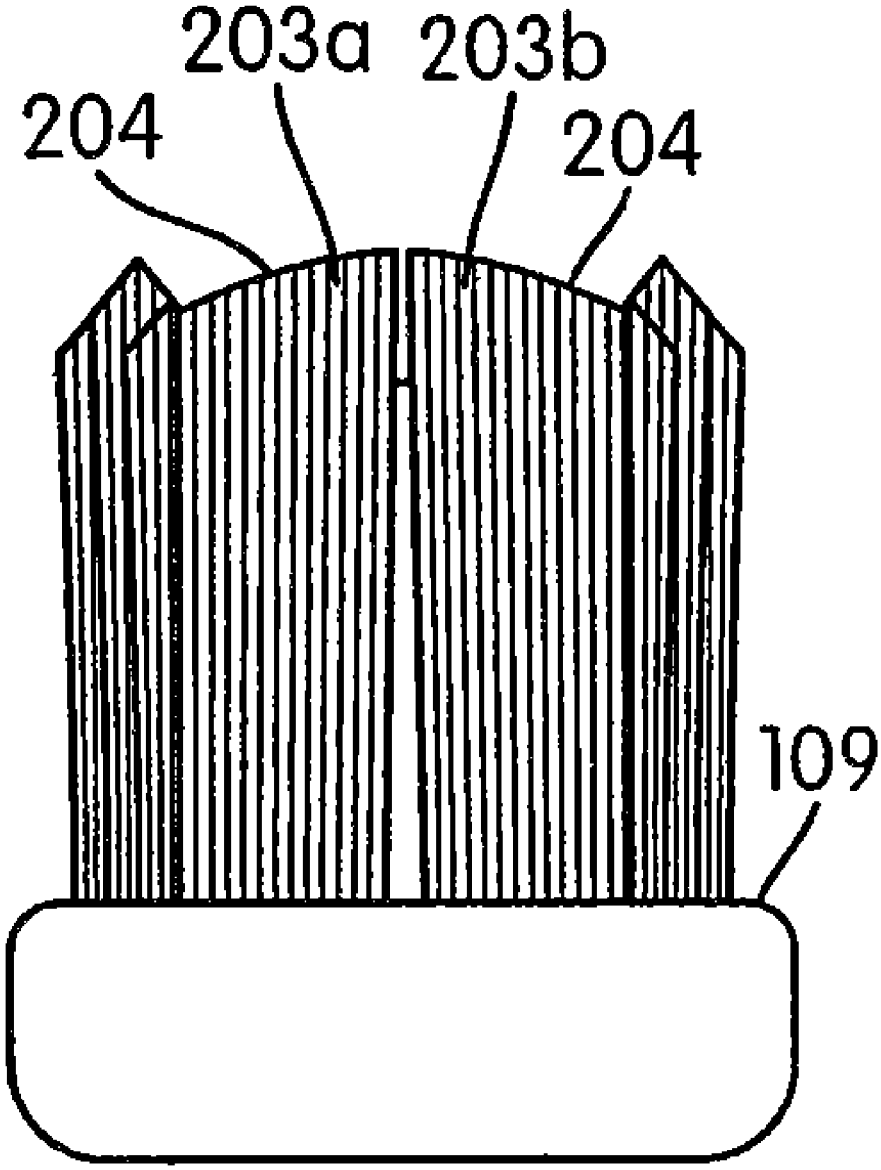
FIG. 7 is a distal end view of the head section of the toothbrush of FIG. 1.

FIGS. 4-6 are sectional views of head 105 that reveal the preferred height characteristics of cleaning elements 207, 209 and 211. In the preferred construction, central cleaning elements 207*a* and 207*c* are shorter than cleaning elements 209 forming loops 214*a*, 214*c* to facilitate enhanced brushing of the lingual and facial tooth surfaces with the dentifrice retained by loops 214*a, c*. The difference between the first height H1 of cleaning elements 207*a, c* and the second height H2 of cleaning elements 209 is preferably about 0.20-2.0 mm, but there could be other variations. Central cleaning element 207*b* is taller than cleaning elements 209 forming central loop 214*b* to facilitate better interproximal cleaning as well as cleaning of the crowns of the molars. The difference between the third height H3 of cleaning element 207*b* and the second height H2 of cleaning elements 209 is preferably about 0.20-2.0 mm, but other variations could be used. While this construction is preferred to maximize the cleaning of various surfaces in the mouth, other variations in the heights of the cleaning elements could be used as desired. For example, central cleaning elements 207 could all have the same heights with each other and as loop cleaning elements 209, or have heights that are higher or lower than the loop cleaning elements in different ways. In another example, the central cleaning elements 209 may have heights that are higher than the loop cleaning elements 209 in a staple configuration of toothbrush 100.

Head 105 also includes distal cleaning elements 203*a-b* at the free end 107. In the preferred construction, a pair of adjacent distal cleaning elements 203*a*, 203*b* straddle longitudinal axis a-a, although they could be formed by one or more than two cleaning elements. Distal cleaning elements 203*a-b* protrude higher from base surface 109 than the tips of the other tooth cleaning elements. The tips of each bristle tuft 203*a-b* collectively define an outermost cleaning surface 204 that is angled with respect to base surface 109 of head 105. By way of example, cleaning surface 204 is preferably at an angle Ø of about 30 degrees to base surface 109, but may also range between 10-50 degrees. It should be recognized that other angular values are possible. The extension and angular orientation of cleaning surface 204 of distal cleaning elements 203*a-b* better enable the user to reach and better clean the teeth in the back of the mouth. Cleaning elements 203*a-b* also can be used to dig into the crevices between the teeth and into the crown portions of the molars. Finally, as can been seen in FIG. 7, the outermost cleaning surface 204 also preferably is sloped laterally downward (to form a crowned surface) to assist in the removal of debris from the teeth.

Peripheral cleaning elements 205*a-c* are positioned near free end 107 and along each side 108 of head 105. These peripheral cleaning elements 205*a-c* are preferably formed by a plurality of bristle tufts that are arranged generally symmetrical with respect to the longitudinal axis a-a. Cleaning elements 205*a-c* are positioned rearward and laterally of distal cleaning elements 203*a-b*. Similarly, peripheral cleaning elements 215*a-c* are also positioned symmetrically about axis a-a along each side 108 near proximal end 111 of head 105. These two groups of cleaning elements 205*a-c*, 215*a-c* are generally mirror images of each other, but could have other constructions. Both the distal and proximal peripheral cleaning elements 205*a-c*, 215*a-c* are generally configured to enable the user to clean along the gum line and in the crevices between the teeth. In the illustrative embodiment, three bristle tufts form each group of peripheral cleaning elements 205*a-c*, 215*a-c*. Nevertheless, more or fewer bristle tufts in these groups may be used. Further, one or more elastomeric elements may be used to define the peripheral cleaning elements in place of or with the bristles.

Figure 3:
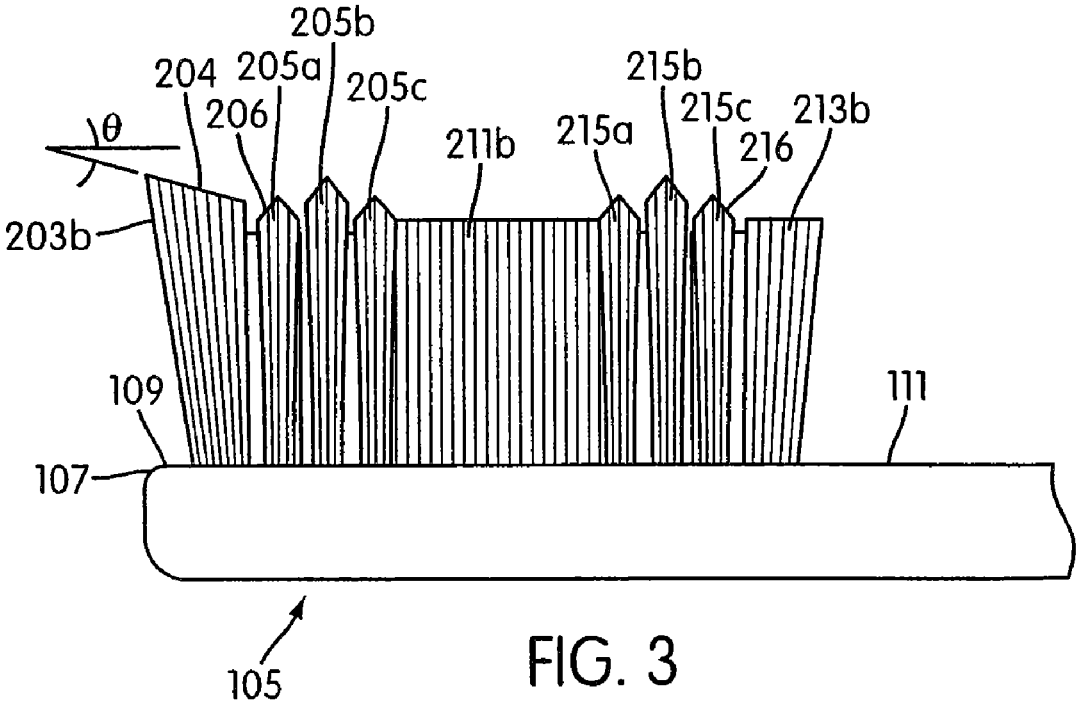
FIG. 3 is an enlarged side view of a head section of the toothbrush of FIG. 1.

As shown in FIG. 3, the tips of the peripheral cleaning elements 205*a-c* and 215*a-c* protrude higher from base surface 109 than the tips of the interior cleaning elements 207, 209, 211. In a preferred embodiment, two groups of peripheral cleaning elements 205, 215 are arranged along each side 108 of head 105. Each group of peripheral cleaning elements includes three generally aligned tufts of bristles, although other numbers of tufts could be used. The center tuft of cleaning elements 205*b*, 215*b* in each group of peripheral cleaning elements protrudes outward farther from base surface 109 than the others tufts 205*a*, 205*c*, 215*a*, 215*c*. This arrangement allows deeper engagement of the tooth surfaces along the gum line with cleaning elements 205*b* or 215*b*, while stimulating the gums with cleaning elements 205*a*, 205*c* and 215*a*, 215*c*. Moreover, each of the tufts has tapered ends 206, 216 to improve the cleaning of the interproximal areas and along the gum line.

Proximal cleaning elements 213*a-b* are positioned near the proximal end 111 of head 105. Preferably a pair of bristle tufts straddle longitudinal axis a-a, but one or more than two cleaning elements could be formed at the proximal end of the head. These proximal cleaning elements 213*a, b* are preferably defined by bristle tufts, but could also include or be defined by one or more elastomeric members.

The inventive aspects may be practiced for a manual toothbrush or a powered toothbrush. In operation, the previously described features, individually and/or in any combination, improves cleaning performance of toothbrushes. These advantages are also achieved by the cleaning elements and the synergistic effects. While the various features of the toothbrush 100 work together to achieve the advantages previously described, it is recognized that individual features and subcombinations of these features can be used to obtain some of the aforementioned advantages without the necessity to adopt all of these features. This unique combination of elements gives exceptional cleaning power in a compact head space.

While the invention has been described with respect to specific examples including presently preferred modes of carrying out the invention, those skilled in the art will appreciate that there are numerous variations and permutations of the above described systems and techniques. Thus, the spirit and scope of the invention should be construed broadly as set forth in the appended claims.

What is claimed is:

1. A toothbrush comprising:

a head having a longitudinal axis that extends from a proximal end of the head to a distal end of the head;

a handle coupled to and extending from the proximal end of the head; and a plurality of tooth cleaning elements extending from a surface of the head, the tooth cleaning elements including:

a plurality of groups of elastomeric walls collectively defining a plurality of substantially closed configurations disposed along the longitudinal axis of the head, the elastomeric walls within each group separated from an adjacent elastomeric wall by a gap, each of the substantially closed configurations comprising at least one gap located on the longitudinal axis of the head;

a central cleaning element disposed within each of the substantially closed configurations; and a plurality of bristles disposed outside of the substantially closed configurations.

2. The toothbrush of claim 1 wherein each of the substantially closed configurations further comprises at least one gap that is not located on the longitudinal axis of the head.

3. The toothbrush of claim 2 wherein the substantially closed configurations are non-concentric and arranged in a spaced-apart manner longitudinally along the longitudinal axis.

4. The toothbrush of claim 3 wherein at least one of the central cleaning elements has a height that is greater than a height of the elastomeric walls of the substantially closed configuration in which the at least one central cleaning elements is disposed.

5. The toothbrush of claim 1 wherein the plurality of bristles disposed outside of the substantially closed configurations comprise a group of peripheral bristle tufts disposed generally parallel to the longitudinal axis and adjacent to a side edge of the head.

6. The toothbrush of claim 5 wherein the group of peripheral bristle tufts includes at least three adjacent peripheral bristle tufts, a central one of the adjacent peripheral bristle tufts extending farther from the surface than end ones of the adjacent peripheral bristle tufts.

7. The toothbrush of claim 1 wherein each group of elastomeric walls comprises at least two arcuate elastomeric walls.

8. The toothbrush of claim 1 wherein each of the substantially closed configurations comprises a center, and wherein the centers of the substantially closed configurations are located on the longitudinal axis and separated from each other by a distance.

9. The toothbrush of claim 1 wherein the plurality of bristles disposed outside of the substantially closed configurations comprise at least one distal cleaning element located at the distal end of the head and at least one proximal cleaning element located at the proximal end of the head.

10. The toothbrush according to claim 9 wherein the distal cleaning element defines an outer cleaning surface facing generally away from the head, wherein the outer cleaning surface is at an acute angle to the head and slopes laterally away from the longitudinal axis of the head.

11. The toothbrush of claim 1 wherein the head is elongated along the longitudinal axis.

12. A toothbrush comprising:

a head having a longitudinal axis that extends from a proximal end of the head to a distal end of the head; and a plurality of tooth cleaning elements extending from a surface of the head, the tooth cleaning elements including:

a first group of elastomeric walls collectively defining a first substantially closed configuration located on the longitudinal axis of the head, wherein gaps exists between adjacent elastomeric walls of the first group;

a second group of elastomeric walls collectively defining a second substantially closed configuration located on the longitudinal axis of the head, wherein gaps exists between adjacent elastomeric walls of the second group; and wherein each of the first and second substantially closed configurations comprise at least one gap located on the longitudinal axis and at least one gap that is not located on the longitudinal axis.

13. The toothbrush of claim 12 further comprising:

a third group of elastomeric walls collectively defining a third substantially closed configuration located on the longitudinal axis of the head, wherein gaps exists between adjacent elastomeric walls of the third group;

wherein the third substantially closed configuration comprises at least one gap located on the longitudinal axis and at least one gap that is not located on the longitudinal axis; and wherein the first substantially closed configuration is formed about a first center located on the longitudinal axis, the second substantially closed configuration is formed about a second center located on the longitudinal axis, and the third substantially closed configuration is formed about a third center located on the longitudinal axis, and wherein the first, second and third centers are separated from each other by a distance.

14. The toothbrush of claim 13 wherein the plurality of tooth cleaning elements further comprises a first central cleaning element located at the first center, a second central cleaning element located at the second center, and a third central cleaning element located at the third center.

15. The toothbrush of 14 further comprising:

the first center located closer to the distal end of the head than the second center;

the second center located closer to the distal end of the head than the third center; and wherein the second central cleaning element has a height that is greater than the elastomeric walls of the second group.

16. The toothbrush of claim 15 wherein the plurality of tooth cleaning elements further comprises a plurality of bristles disposed outside of the first, second and third substantially closed configurations.

17. The toothbrush of claim 16 wherein the plurality of bristles comprises at least one distal cleaning element at the distal end of the head and at least one proximal cleaning element at the proximal end of the head, the distal cleaning element having a height that is greater than a height of the elastomeric walls of the first, second and third groups.

18. The toothbrush of claim 17 wherein the plurality of bristles comprises at least one peripheral cleaning element located outside of and laterally adjacent to the second substantially closed configuration.

19. A toothbrush comprising:

a head having a longitudinal axis that extends from a proximal end of the head to a distal end of the head; and a plurality of tooth cleaning elements extending from a surface of the head, the tooth cleaning elements including:

a plurality of groups of elastomeric walls collectively defining a plurality of substantially closed configurations disposed non-concentrically along the longitudinal axis of the head, the elastomeric walls within each group separated from an adjacent elastomeric wall by a gap, each of the substantially closed configurations comprising at least one gap located on the longitudinal axis of the head and at least one gap that is not located on the longitudinal axis of the head; and a plurality of bristles disposed outside of the substantially closed configurations, the bristles comprising at least one distal cleaning element located at the distal end of the head and at least one proximal cleaning element located at the proximal end of the head.

20. The toothbrush of claim 19 further comprising:

the plurality of tooth cleaning elements further comprising:

a central bristle tuft disposed within each of the substantially closed configurations, wherein at least one of the central bristle tufts has a height that is greater than a height of the elastomeric walls of the substantially closed configuration in which the at least one central bristle tuft is disposed;

a group of peripheral bristle tufts disposed generally parallel to the longitudinal axis and adjacent to a side edge of the head, the group of peripheral bristle tufts including at least three adjacent peripheral bristle tufts, a central one of the adjacent peripheral bristle tufts extending farther from the surface than end ones of the adjacent peripheral bristle tufts;

each of the substantially closed configurations comprising a center, and wherein the centers of the substantially closed configurations are located on the longitudinal axis and separated from each other by a distance; and the distal cleaning element defining an outer cleaning surface facing generally away from the head, wherein the outer cleaning surface is at an acute angle to the head and slopes laterally away from the longitudinal axis of the head.

* * * * *